US008801334B2

(12) United States Patent
Paulus et al.

(10) Patent No.: US 8,801,334 B2
(45) Date of Patent: Aug. 12, 2014

(54) METHOD FOR PRODUCING AN UNDERWATER FOUNDATION ELEMENT, ADJUSTMENT HEAD FOR AN UNDERWATER FOUNDATION ELEMENT AND UNDERWATER WORKING ARRANGEMENT

(75) Inventors: Simon Paulus, Schrobenhausen (DE); Christoph Schwanz, Schrobenhausen (DE); Ulli Wiedenmann, Schrobenhausen (DE)

(73) Assignee: Bauer Spezialtiefbau GmbH, Schrobenhausen (DE)

( * ) Notice: Subject to any disclaimer, the term of this patent is extended or adjusted under 35 U.S.C. 154(b) by 0 days.

(21) Appl. No.: 13/492,523

(22) Filed: Jun. 8, 2012

(65) Prior Publication Data

US 2012/0315097 A1 Dec. 13, 2012

(30) Foreign Application Priority Data

Jun. 10, 2011 (EP) ..... 11004784

(51) Int. Cl.
*E02D 27/50* (2006.01)
*E02D 27/52* (2006.01)

(52) U.S. Cl.
USPC ..... 405/227; 405/224

(58) Field of Classification Search
USPC ..... 405/203, 222, 224, 225, 227, 228
See application file for complete search history.

(56) References Cited

U.S. PATENT DOCUMENTS

| | | | | |
|---|---|---|---|---|
| 4,102,147 | A | 7/1978 | Jansz | |
| 4,904,119 | A * | 2/1990 | Legendre et al. | 405/228 |
| 5,244,312 | A | 9/1993 | Wybro et al. | |
| 5,667,341 | A * | 9/1997 | Kuehn | 405/228 |
| 6,012,328 | A * | 1/2000 | Pohlmann | 73/84 |
| 6,354,767 | B1 * | 3/2002 | Jones | 405/232 |
| 7,308,821 | B1 * | 12/2007 | Pohlmann | 73/84 |
| 2008/0226398 | A1 * | 9/2008 | Gibberd et al. | 405/223 |
| 2011/0158752 | A1 * | 6/2011 | Hitchin | 405/232 |

FOREIGN PATENT DOCUMENTS

| | | | |
|---|---|---|---|
| GB | 2 316 486 | A | 2/1998 |
| WO | 2010/015799 | A2 | 2/2010 |

OTHER PUBLICATIONS

European Search Report dated Jan. 5, 2012; EP Application No. 11 00 4784.2.

* cited by examiner

*Primary Examiner* — Benjamin Fiorello
(74) *Attorney, Agent, or Firm* — Studebaker & Brackett PC

(57) ABSTRACT

A method for producing an underwater foundation element in a bed of a body of water, in which a working platform for guiding a drilling tool is lowered to the bed of a body of water, so that a drill-hole is introduced into the bed of a body of water and a pile-shaped underwater foundation element is arranged in the drill-hole and anchored therein. A precise alignment is achieved in that on the pile-shaped underwater foundation element a measuring unit is fixed, through which positional data of the pile-shaped underwater foundation element are determined and in that depending on the determined positional data the position of the underwater foundation element is set by at least one positioning means on the working platform prior to anchoring. The measuring unit is arranged on an adjustment head.

11 Claims, 2 Drawing Sheets

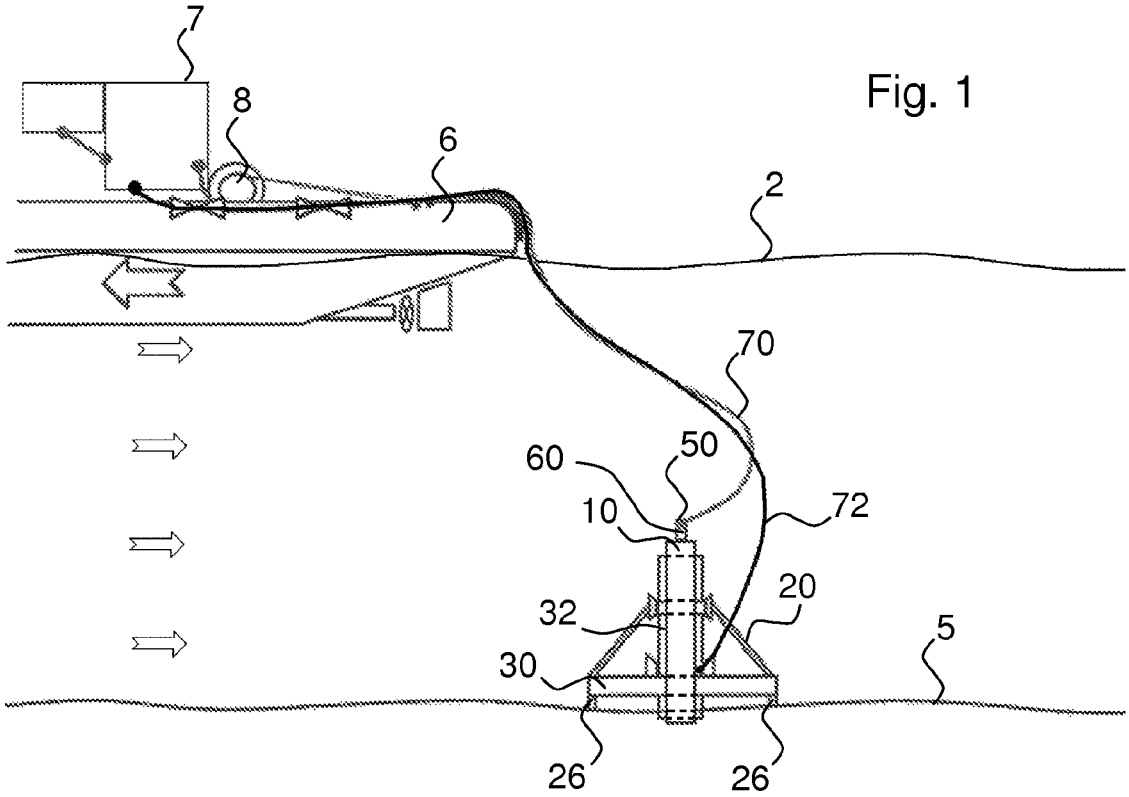
Fig. 1
Fig. 2
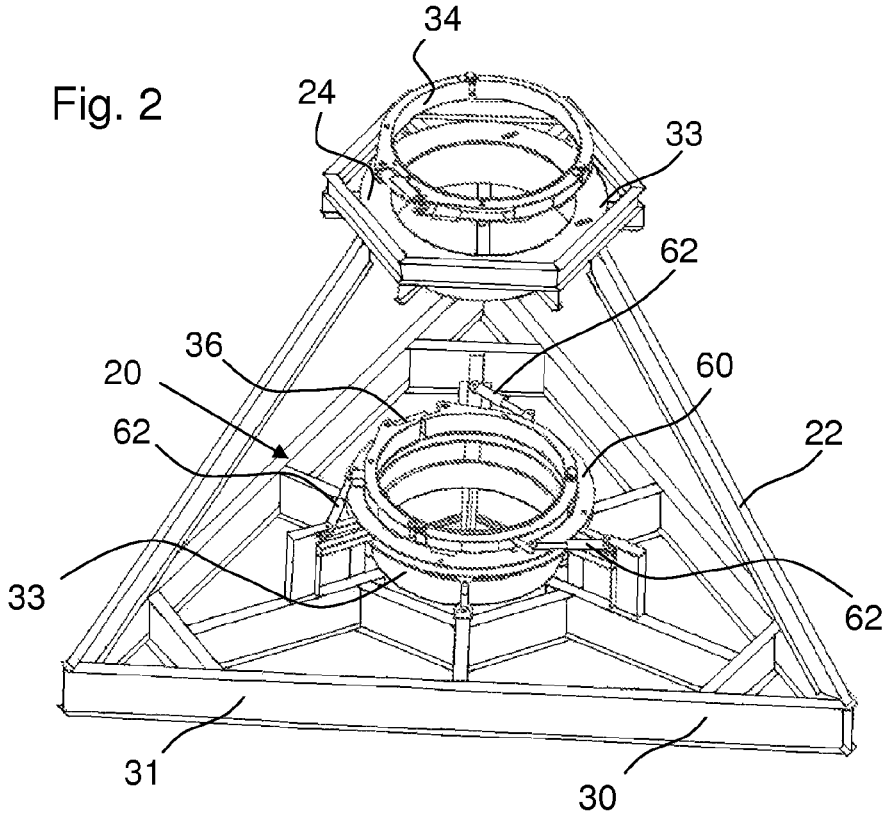

METHOD FOR PRODUCING AN UNDERWATER FOUNDATION ELEMENT, ADJUSTMENT HEAD FOR AN UNDERWATER FOUNDATION ELEMENT AND UNDERWATER WORKING ARRANGEMENT

FIELD OF THE INVENTION

The invention relates to a method for producing an underwater foundation element in a bed of a body of water, in which a working platform for guiding a drilling tool is lowered to the bed of a body of water, with the drilling tool a drill-hole is introduced into the bed of a body of water and a pile-shaped underwater foundation element is arranged in the drill-hole and anchored therein.

Furthermore, the invention relates to an underwater working arrangement for anchoring a pile-shaped underwater foundation element in the bed of a body of water comprising a submersible working platform and a receiving means arranged on the working platform for the underwater foundation element.

BACKGROUND OF THE INVENTION

Such a method and such a working arrangement can be taken from EP 2 322 724 A1. With these, foundation elements can be anchored in a reliable manner under water in a bed of a body of water. Foundation elements of such type serve, for example, for the anchoring of offshore wind power plants or flow turbines of tidal power stations in the sea.

Another method of such type is known from GB 2 469 190 A. Due to the extremely difficult work conditions under water the problem exists that the pile-shaped foundation elements show minor positional deviations amounting, for example, to a few angular degrees to the vertical. If, for instance, the mast for a wind power plant with a length of up to 100 m is erected on such foundation elements there will, in the case of a small deviation of the foundation element, already be a relatively large inclination of the entire plant.

To avoid such inclinations it is known to fix a compensating means between the foundation element and a mast to be fixed thereon. With such a compensating means a positional inaccuracy of the foundation element can be compensated. However, such compensating means are costly and constitute a weakening of the entire construction. In particular, the compensating means can be mechanically vulnerable or vulnerable with regard to corrosive conditions in salt water.

SUMMARY OF THE INVENTION

The invention is based on the object to provide a method for producing an underwater foundation element, with which such a foundation element can be produced at a high positional accuracy. Furthermore, the object of the invention is to provide an underwater working arrangement as well as an adjustment head for this.

The method according to the invention is characterized in that on the pile-shaped underwater foundation element a measuring unit is fixed, through which the positional data of the pile-shaped underwater foundation element are determined and in that depending on the determined positional data the position of the underwater foundation element is set by means of at least one positioning means on the working platform prior to anchoring.

A fundamental idea of the invention resides in the fact that a measuring unit is fixed directly on the underwater foundation element, with which the position of the foundation element is determined. Hence, instead of carrying out an indirect positional determination via the position of the working platform, a direct and therefore very precise positional determination of the foundation element is effected. Depending on the determined positional data the position of the underwater foundation element is then adjusted by means of at least one positioning means on the working platform, more particularly several hydraulic cylinders, prior to anchoring. As soon as the measuring unit indicates the desired precise position of the underwater foundation element, the foundation element is fixed in this position with respect to the working platform and subsequently anchored in the bed of a body of water, in particular by introducing a hardening suspension, especially concrete.

As a result, underwater foundation elements with very narrow tolerance ranges regarding the position can be produced. This allows the mast or other plant or construction to be flange-mounted or fastened on the foundation element without a compensating means. In this way, a very stable and also robust overall construction of the plant is achieved.

Basically, it is conceivable to provide the measuring unit as a lost measuring unit in a fixed manner on the foundation element. According to the invention it is especially efficient that the measuring unit is releasably fixed on an upper area of the underwater foundation element and, after setting, is released again from the underwater foundation element and removed. In this way, the measuring unit can be employed several times so that measuring instruments of very high quality and high precision can be used for the measuring unit.

Moreover, according to the invention it is preferred that by means of the at least one positioning means for setting the position of the underwater foundation element positioning forces are generated which are transmitted via an adjustment head and/or a receiving means of the working platform to the underwater foundation element. In particular, the adjustment head can be releasably fastened on the upper side of the pile-shaped foundation element. The adjustment head has corresponding coupling elements, especially drivers, through which the positioning means are able to transmit their positioning forces, in particular a twist movement around the longitudinal axis, in a defined manner to the foundation element. By preference, lateral changes of position are transmitted to the foundation element via an approximately drum-shaped receiving means, in which the pile-shaped foundation element is received and guided. To this end the receiving means is preferably supported in a movable manner on the base frame of the working platform and can be adjusted via positioning means. In this way, even very small changes of position of the underwater foundation element can be implemented precisely.

According to the invention it is especially advantageous for the positioning means to be controlled via a control means which is arranged together with the measuring unit on the adjustment head. In this way, the measurement results of the measuring unit can be transmitted directly to the positioning means so that a quick and reliable adjustment of the underwater foundation element in the bed of a body of water can take place.

According to the invention provision is furthermore made for an adjustment head for an underwater foundation element to be arranged with a base support, a connecting means for releasably connecting the adjustment head to the underwater foundation element, at least one measuring unit arranged on the base support for determining positional data of the underwater foundation element and an attachment means for attaching and holding the adjustment head on a connecting line.

In line with the method according to the invention as described above the adjustment head can be rigidly fixed in a defined manner on the foundation element. By preference, a centering means is provided, with which the adjustment head is brought into a defined position on the foundation element. Here, the connecting means can have hydraulic tension clamps for example. The adjustment head is connected via a connecting line to a supply vessel. To this end an attachment means is designed on the upper side of the adjustment head which serves for attaching and holding the adjustment head on the connecting line. In addition to a hook element for mechanical fastening corresponding attachments for electricity, hydraulic fluid and data lines are provided, too.

Good adjustment of the foundation element is achieved according to the invention in that at least one coupling element is provided for establishing a connection of the adjustment head with a working platform receiving the underwater foundation element. In this way, an adjustment of the foundation element can be effected via the adjustment head. The foundation element rests on the bottom of the drill-hole so that positioning forces can be transmitted in an especially effective manner via the adjustment head arranged on the upper side of the foundation element.

According to the invention it is particularly preferred that via the coupling element positioning forces can be transmitted from a positioning means on the working platform to the adjustment head and the connected underwater foundation element. The positioning means can have one or several hydraulic cylinders, the pistons of which act directly on the adjustment head. Alternatively, by way of the adjustment head a rigid connection can be established to the working platform and, in particular, to the drum-shaped receiving means of the working platform. For adjustment a shifting of the receiving means and/or the working platform as a whole can then take place, for instance through contact feet of the working platform on the bed of a body of water that are provided with hydraulic cylinders.

An especially useful embodiment of the adjustment head results in accordance with the invention from the fact that the attachment means is designed to transmit electrical energy, hydraulic energy, control signals and/or fluid for anchoring the underwater foundation element in the bed of a body of water. Hence, the adjustment head not only constitutes an element for the mechanical alignment of the foundation element but provides a plurality of functions including measuring and passing hardening fluid, such as cement suspension, into the pipe-shaped foundation pile for the purpose of anchoring after alignment.

Accordingly, a preferred embodiment of the invention resides in the fact that the attachment means has a passage for hardening fluid to an inner cavity of a pipe-shaped underwater foundation element.

With regard to the underwater working arrangement the object is solved by a corresponding working arrangement, which is characterized in that on the underwater foundation element a given adjustment head is fixed for determining positional data and in that at least one positioning means is provided with which a position of the underwater foundation element in the receiving means can be adjusted depending on the determined positional data. As a result, the previously described high-precision alignment of the underwater foundation element in the bed of a body of water is achieved.

In accordance with the invention a preferred embodiment resides in the fact that as positioning means a twist means for twisting the pile-shaped underwater foundation element around a center axis, a lifting means for adjusting the underwater foundation element longitudinally of the center axis and/or a tilting means for adjusting the underwater foundation element transversely to the center axis is provided. Through corresponding positioning means on the working platform the underwater foundation element can be aligned precisely whilst still being surrounded by a drum-shaped receiving means on the working platform. The twist means comprises a clamping ring which can be twisted around the drilling axis by means of horizontally directed positioning cylinders. By preference, the twist movement is transmitted via the drum-shaped receiving means to the adjustment head and therefore the foundation element.

The drum-shaped receiving means also serves to guide the drilling tool during the introduction of the drill-hole. For adjustment of the foundation element the receiving means can be adjusted. Alternatively, the elements forming the interior of the drum-shaped receiving means can be modified with respect to the guide position of the drilling tool, thereby allowing for sufficient space to adjust and change the position of the underwater foundation element within the drum-shaped receiving means.

Basically, it is possible that, depending on the measurement data of the adjustment head, an alignment of the foundation element is effected via an external control means on the supply vessel. According to the invention it is especially preferred that a control means is provided for controlling at least one positioning means. Such a control means on the underwater working arrangement or on the adjustment head permits a high-precision alignment of the foundation element.

BRIEF DESCRIPTION OF THE DRAWINGS

The invention will be described further by way of preferred embodiments which are illustrated schematically in the accompanying drawings, wherein show:

FIG. 1 a schematic view of an underwater working arrangement according to the invention;

FIG. 2 a perspective schematic view concerning the underwater working arrangement of FIG. 1;

DETAILED DESCRIPTION OF THE PREFERRED EMBODIMENTS

Figure 4:
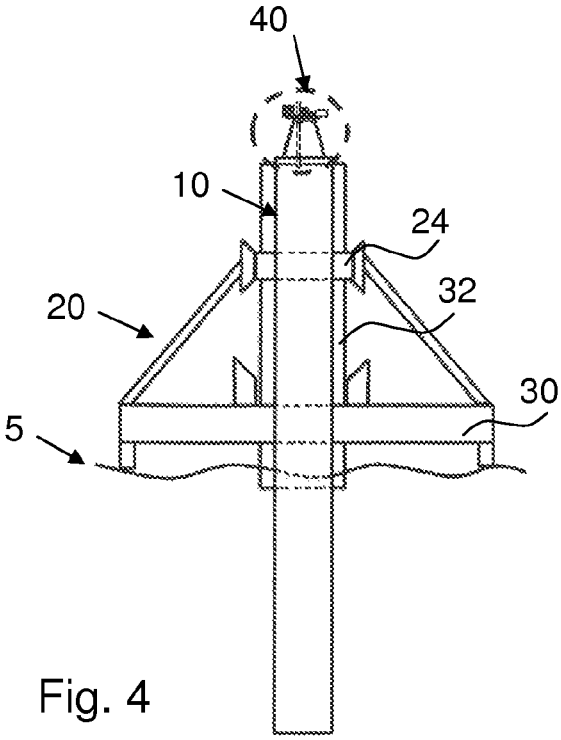
FIG. 4 an underwater working arrangement with an adjustment head according to the invention.

According to the invention, for the production of an underwater foundation element 10 in a bed of a body of water 5 a working platform 30 is lowered as an underwater working arrangement 20 from a supply vessel 6 to the seabed 5 in accordance with FIG. 1. Via adjustable contact elements 26 the underwater working arrangement 20 is aligned horizontally. Subsequently, a drill-hole is introduced into the bed of a body of water 5 by way of a drilling tool, not depicted. Following removal of the drilling tool from the underwater working arrangement 20 the pipe-shaped underwater foundation element 10 is inserted into a drum-shaped receiving means 32 and placed in the drill-hole onto the drill-hole bottom, as also shown in FIG. 4.

By way of a supply line 70 that is coupled via an attachment means 50 and an adjustment head 40 with the upper side of the underwater foundation pile 10 in this case the underwater foundation element 10 is connected to a supply vessel 6 on the sea surface 2. The supply line 70, which comprises both a steel rope for holding the adjustment head 40 and further supply lines, is actuated via a winch 8 on the supply vessel 6. By way of a control means 7 on the supply vessel 6 a control of the adjustment head 40 via the supply line 70 as well as of the underwater working arrangement 20 via a connection 72 is effected from the sea surface 2.

An exemplary embodiment of a working platform 30 of the underwater working arrangement 20 according to the invention is illustrated in FIG. 2. From steel beams an approximately triangular base frame 31 of the working platform 30 is formed, on which contact elements, not depicted, more particularly hydraulic cylinders, are arranged for placement onto the bed of a body of water 5. Via three diagonal struts 22 the corner areas of the base frame 31 are firmly connected to a plate-shaped platform head 24. On the platform head 24 and on the base frame 31 ring-shaped holding elements are arranged for the drum-shaped receiving means 32, not depicted here. On the platform head 24 a first hydraulically actuated collet 34 is provided which serves to establish a firm connection to the receiving means 32 for the inserted underwater foundation element 10.

A second collet 36 is also designed on the working platform 30, in which case the second collet 36 can be actuated by three horizontally arranged twist cylinders 62 in order to twist the hydraulically clamped receiving means 32 with the underwater foundation element 10. To constitute a positioning means 60 the entire three twist cylinders 62 can also be actuated such that they cause not only a twist movement around a center axis 11 but also a desired tilting with respect to the center axis 11. In this way, a precise alignment of the inserted underwater foundation element 10 in the drill-hole in the bed of a body of water 5 is rendered possible. Following precise adjustment of the underwater foundation element 10, a self-hardening fluid can then be introduced into the drill-hole for final anchoring. After the underwater foundation element 10 has been anchored the underwater working arrangement 20 can then be released in its entirety from the anchored underwater foundation element 10 and removed again.

Figure 3:
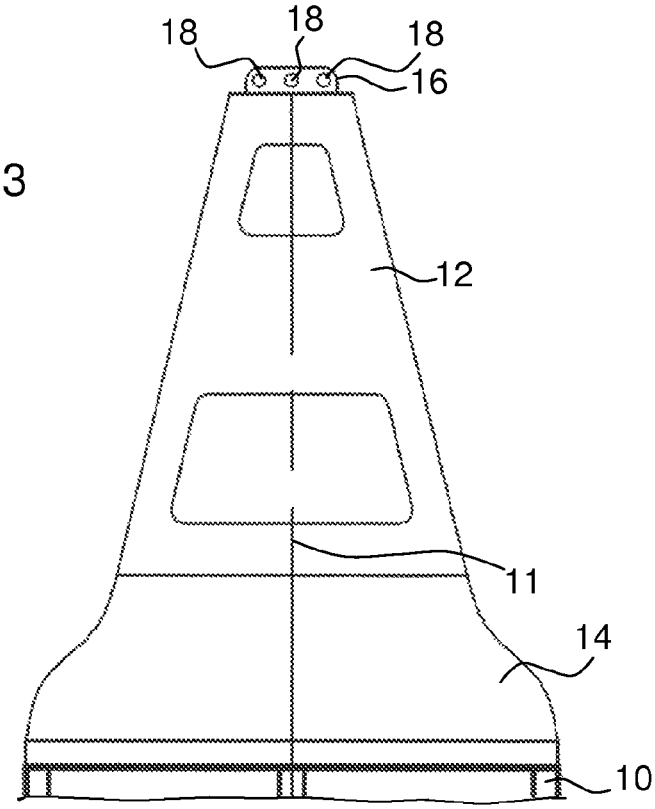
FIG. 3 a head area of an underwater foundation element.
Figure 5:
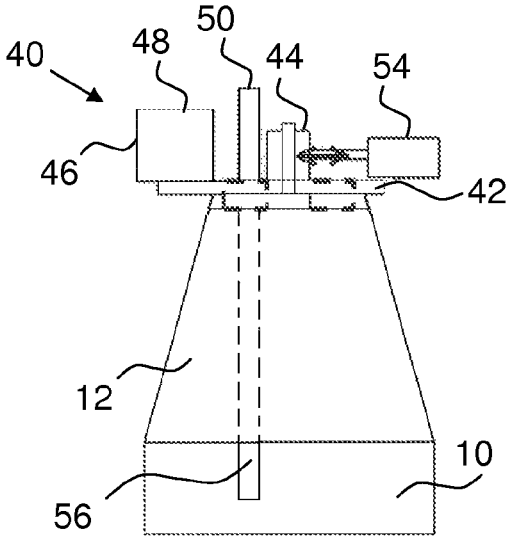
FIG. 5 a schematic side view of an adjustment head according to the invention.

For a precise alignment of the underwater foundation element 10 an adjustment head 40 is provided according to the invention which is described in greater detail in conjunction with FIGS. 3 to 5.

In the upper area of the underwater foundation element 10 a conical pile head 12 is arranged which is firmly connected via a base 14 to the cylindrical area of the foundation element 10. At the upper end of the pile head 12 a protruding plate-shaped sword 16 with three center holes 18 is arranged. According to the illustrations of FIGS. 4 and 5 an adjustment head 40 is placed onto this upper end of the pile head 12 and firmly anchored in a defined position on the pile head 12 via a connecting means 44 depicted schematically only. To this end the connecting means 44 has hydraulic positioning cylinders, not illustrated, with which centering pins engage into the center holes 18 on the sword 16 and thereby establish a firm form-locking connection.

The adjustment head 40 according to the invention has a plate-shaped base support 42 that rests on the upper side of the pile head 12. On an upper side of the base support 42 a measuring unit 46 and a control means 48 are arranged. The measuring unit 46 is equipped with a plurality of position sensors so that these can determine a precise position of the underwater foundation element 10 and in particular deviations with respect to the vertical. By way of stationary coupling elements 54 an additional stable connection can be established via the adjustment head 40 to the underwater working arrangement 20. Irrespective of the determined measurement data of the measuring unit 46 the at least one positioning means 60 on the underwater working arrangement 20 can be actuated by way of the control means 48, which is connected via the supply line 70 to the control 7 on the supply vessel 6, so that the position of the underwater foundation element 10 is changed relative to the working platform 30.

On reaching the desired precise position of the underwater foundation element 10 in the drill-hole, cement suspension for example is introduced via the attachment means 50, indicated schematically only in FIG. 5, by means of a suspension supply through the adjustment head 40 from the supply vessel 6 into the interior of the pipe-shaped underwater foundation element 10. For this purpose a passage 56 reaching into the underwater foundation element 10 is designed. On completion of anchoring of the underwater foundation element 10 the adjustment head 40 is released from the underwater foundation element 10 and retrieved via the supply line 70 onto the supply vessel 6. Afterwards, the underwater working arrangement 20 is released from the underwater foundation element 10 and removed via connection 72.

The invention claimed is:

1. A method for producing an underwater foundation element in a bed of a body of water, said method comprising lowering a working platform for guiding a drilling tool to a bed of a body of water, introducing a drill-hole with the drilling tool into the bed of the body of water, arranging a pile-shaped underwater foundation element in the drill-hole and anchored therein, fixing a measuring unit on the pile-shaped underwater foundation element through which positional data of the pile-shaped underwater foundation element are determined, and positioning the underwater foundation element depending on the determined positional data of the underwater foundation element by at least one positioning arrangement on the working platform prior to anchoring.

2. The method according to claim 1, wherein the measuring unit is releasably fixed on an upper area of the underwater foundation element and, after setting, is released from the underwater foundation element and removed.

3. The method according to claim 1, wherein by the at least one positioning arrangement for setting the position of the underwater foundation element, positioning forces are generated which are transmitted by at least one of an adjustment head and a receiving device of the working platform to the underwater foundation element.

4. The method according to claim 3, wherein the positioning arrangement is controlled via a control device which is arranged together with the measuring unit on the adjustment head.

5. An underwater working arrangement for anchoring a pile-shaped underwater foundation element in the bed of a body of water, said underwater working arrangement comprising a submersible working platform, and a receiver arranged on the working platform for the underwater foundation element, on the underwater foundation element, an adjustment head including a base support, a connecting device releasably connecting an adjustment head to the underwater foundation element, at least one measuring unit arranged on the base support for determining positional data of the underwater foundation element, and an attachment connector for attaching and holding the adjustment head on a connecting line is fixed for determining positional data, and at least one positioning device, with which a position of the underwater foundation element in the receiver is adjusted depending on determined positional data.

6. The underwater working arrangement according to claim 5, wherein at least one coupling element is provided for establishing a connection of the adjustment head with a working platform receiving the underwater foundation element.

7. The underwater working arrangement according to claim 6, wherein via the coupling element positioning forces are transmitted from a positioning device on the working platform to the adjustment head and the connected underwater foundation element.

8. The underwater working arrangement according to claim 5, wherein the attachment connector transmits at least one of electrical energy, hydraulic energy, control signals and fluid for anchoring the underwater foundation element in the bed of a body of water.

9. The underwater working arrangement according to claim 5, wherein the attachment connector has a passage for transferring hardening fluid to an inner cavity of a pipe-shaped underwater foundation element.

10. The underwater working arrangement according to claim 5, wherein the positioning device includes at least one of a twist cylinder arranged for twisting or turning the pile-shaped underwater foundation element around a center axis, a lifting device for adjusting the underwater foundation element longitudinally of a center axis, and a tilting device for adjusting the underwater foundation element transversely to the center axis.

11. The underwater working arrangement according to claim 5, wherein a controller is provided for controlling the at least one positioning device.

* * * * *